US006471597B1

(12) United States Patent
Flannery et al.

(10) Patent No.: US 6,471,597 B1
(45) Date of Patent: Oct. 29, 2002

(54) OPEN TOP SWING

(75) Inventors: Mark A. Flannery, Shorewood, MN (US); Timothy L. Edwards, Wyoming, MI (US)

(73) Assignee: Regalo International, LLC, Plymouth, MN (US)

( * ) Notice: Subject to any disclaimer, the term of this patent is extended or adjusted under 35 U.S.C. 154(b) by 0 days.

(21) Appl. No.: 09/699,139

(22) Filed: Oct. 27, 2000

(51) Int. Cl.[7] ..... A63G 9/16
(52) U.S. Cl. ..... 472/119; 297/273
(58) Field of Search ..... 472/118, 119, 472/120, 121, 122, 123, 124, 125; 297/273

(56) References Cited

U.S. PATENT DOCUMENTS 4,822,033 A * 4/1989 Kohus et al. ..... 472/119
D368,816 S 4/1996 Mitchell et al.
5,525,113 A 6/1996 Mitchell et al.
5,803,817 A 9/1998 Stern
5,846,136 A * 12/1998 Wu ..... 472/119
D412,067 S 7/1999 Wu
6,022,277 A * 2/2000 Jankowski ..... 472/119
6,027,409 A 2/2000 Favorito et al.
6,059,667 A * 5/2000 Pinch ..... 472/119

* cited by examiner

*Primary Examiner*—Kien T. Nguyen

(57) ABSTRACT

An open top baby swing having a frame which in turn includes legs and a base and wherein the legs of the frame extend from only a front portion of the base. A transition from the base to the legs is integral so as to provide a solid frame. Upper ends of the transition are tied together with a cross member. A swing mechanism for controlling swinging of the baby seat includes two drive trains isolated from each other by a coil spring. Any movement or ceasing thereof by one end of the first drive train exerts a respective movement or ceasing thereof on the end of the coil spring to which the other end of the first drive train is engaged, and vice versa. Any movement or ceasing thereof by one end of the second drive train exerts a respective movement or ceasing thereof on the end of the coil spring to which the other end of the second drive train is engaged, and vice versa. A control unit for the swing mechanism includes a bank of lights running in a line that is user friendly.

13 Claims, 3 Drawing Sheets

OPEN TOP SWING

BACKGROUND OF THE INVENTION

The present invention relates to baby swings and, more particularly, to open top swings.

An open top swing is a baby swing having no crossbar over a top portion of the swing. The open top provides a convenient and safe way to pick up an infant or toddler. The open top is convenient because the caregiver can approach the infant easily to provide care. The open top is safe because, without a crossbar across the top of the swing, placing the infant or toddler in the baby seat and taking the infant or toddler out of the baby seat can be done easily and without a struggle. For example, the feet of a toddler or infant may get caught in a portion of the seat, especially the feet of a struggling toddler or a sleeping infant. With a conventional baby swing having a top extending crossbar, a struggling toddler or sleeping child would be lifted a slight way up so that his or her feet would clear the seat and then lifted horizontally across the baby seat so as not to hit the head of the child on the underside of the crossbar. However, with an open top swing, the horizontal lifting or the back-straining lift change from a vertical lift to a horizontal lift is unnecessary because the child may be lifted straight up out of the seat.

SUMMARY OF THE INVENTION

A feature of the present invention is the provision in an open top swing having no crossbar across the top of the swing, of the baby seat being supported relative to the floor solely by two legs extending from a front portion of a base on the floor.

Another feature of the present invention is the provision in such an open top swing of the two legs curving upwardly and rearwardly so as to provide a sweeping look to the open top swing.

Another feature of the present invention is the provision in such an open top swing, of a transition from the base to the legs being integral so as to provide solid support for the two legs.

Another feature of the present invention is the provision in such an open top swing of a base cross member extending between the integral transition and engaging the integral transition at a location spaced from the floor.

Another feature of the present invention is the provision in an open top swing having no crossbar across the top of the swing, of a swing mechanism having first and second drive trains and a coil spring between the drive trains, wherein a movement or a ceasing of a movement at the end of the first drive train distal to the coil spring brings about an immediate movement or ceasing of movement to a first end of the coil spring and wherein a movement or a ceasing of a movement at the end of the second drive train distal to the coil spring brings about an immediate movement or ceasing of movement to a second end of the coil spring such that adjacent elements of the drive trains are fixed to each other and immediate movement or a ceasing of movement of one element immediately brings about a movement or a ceasing of movement of its adjacent element.

Another feature of the present invention is the provision in an open top swing having no cross bar across the top of the swing, of a control unit that has a display of lights running in a line so that a caregiver can easily determine how fast the swing is swinging and can easily remember the rate of swinging preferred by the child.

An advantage of the invention is that it is safe. The provision of an integral transition between the base and the leg provides solid support for the baby swinging in the baby seat. A front crossbar engages the integral transition at the upper part of the integral transition. The base is relatively wide and deep.

Another advantage of the present invention is that the frame of the open top swing is relatively inexpensive and simple to manufacture and assemble.

Another advantage of the present invention is that the swing mechanism is simple and has relatively few parts.

Another advantage of the present invention is that the control unit is simple to understand, operate and read.

Another advantage of the present invention is that it retains the conventional feature of an open top swing, the absence of a crossbar across the top.

Another advantage of the present invention is that it provides a "middle" crossbar hat has a crossbar portion that engages the legs at a location spaced from the floor and, at he same time, has another crossbar portion that lies on the floor.

Another advantage of the present invention is that it is aesthetic.

DESCRIPTION

Figure 2:
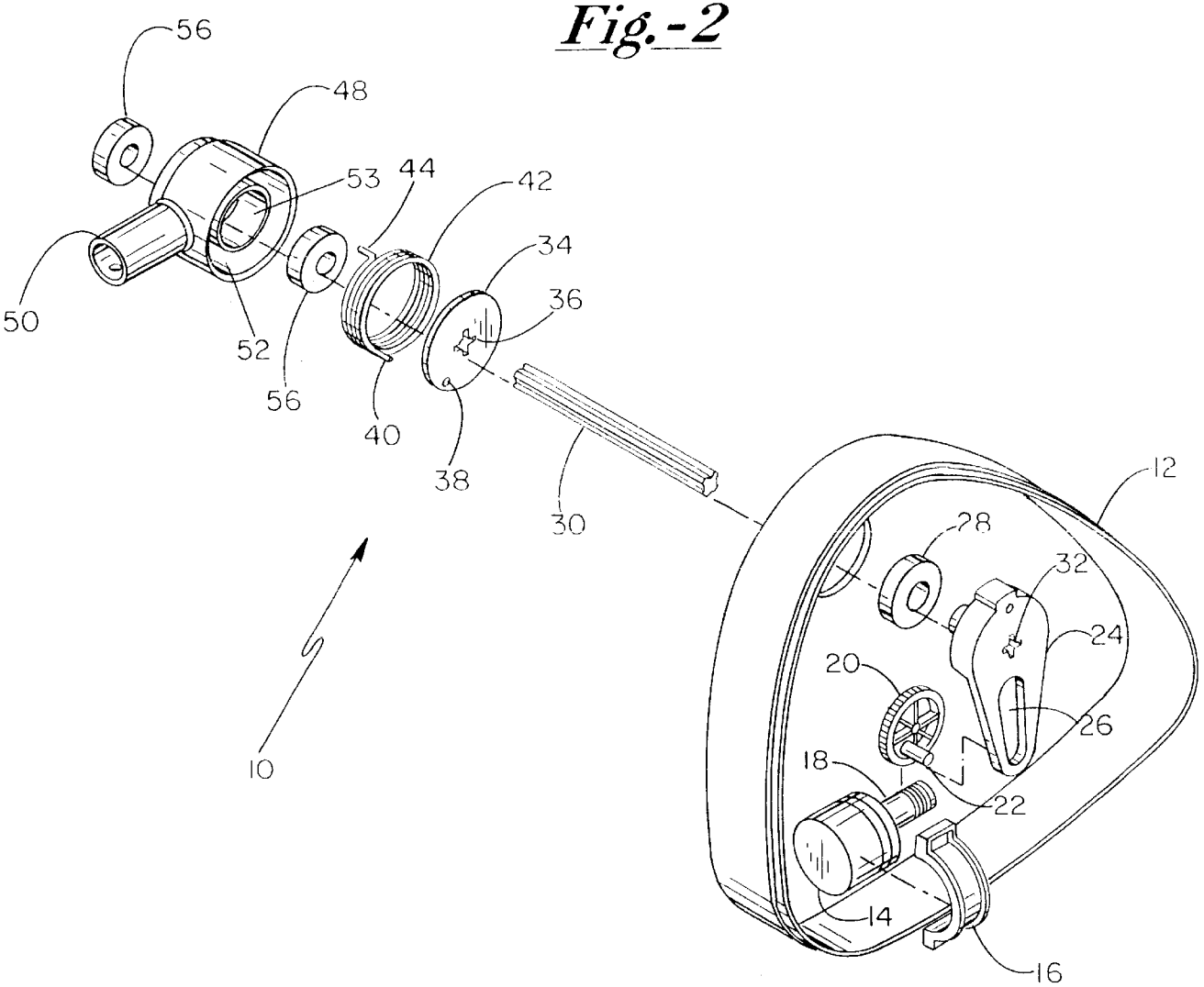
FIG. 2 shows a perspective, exploded view of the swing mechanism for the open top swing of FIG. 1.
Figure 3:
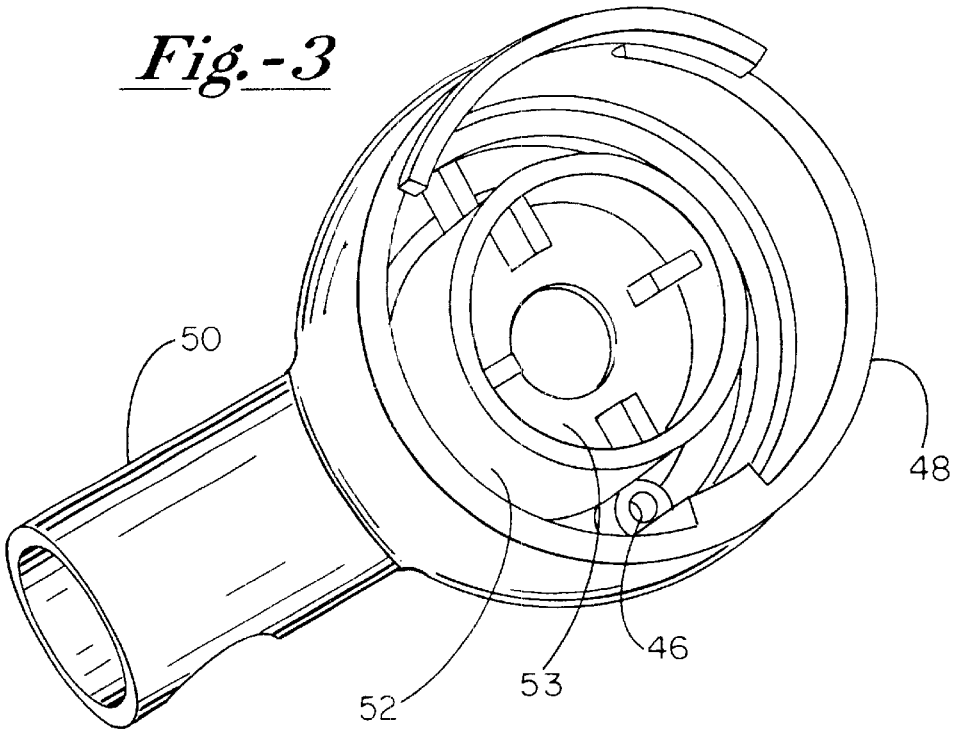
FIG. 3 shows a detail view of the hanger mount of the swing mechanism of FIG. 2.

As shown by FIG. 2, the swing mechanism of the present invention is generally designated by reference number 10. The swing mechanism 10 includes a housing 12. An electric motor 14 is fixed to the housing 12 with a bracket 16. A worm gear 18 extends from and is immediately driven by the motor 14. A rotating gear 20 is pivotally affixed to the housing 12 and includes a crank 22. The crank 22 immediately drives an axle drive 24 by engaging a slot 26 formed in the axle drive 24. The axle drive 24 is mounted to the housing 12 via a bearing 28. The axle drive 24 fixedly receives and immediately drives an axle 30. The axle 30 is splined and an aperture 32 in the axle drive 24 is formed to receive the spline of the axle 30 such that there is no rotation or oscillation between the axle 30 and the axle drive 24. A disk shaped cap 34 also receives the axle 30 in a nonrotating, fixed fashion. The disk shaped cap 34 includes an aperture 36 formed to receive the spline of the axle 30 such that there is no rotation or oscillation between the axle 30 and the disk shaped cap 34 and such that the axle 30 immediately drives the cap 34. The disk shaped cap 34 includes a periphery that includes an aperture 38. Aperture 38 receives one pin like end 40 of an integral coil spring 42 such that the cap 34 immediately drives end 40 of the coil spring 42. Coil spring 42 includes an opposite pin like end 44. This opposite pin like end 44 is received in an aperture 46 (please see FIG. 3) that is formed in a hanger mount 48 such that end 44 immediately drives hanger mount 48. Hanger mount 48 has a tube like end 50 for receiving the proximal end of a hanger 66 such that mount 48 immediately drives hanger 66. The distal end of the hanger 66 is engaged to a baby seat 68.

Hanger mount 48 has a pair of annular recesses 52 and 53. Outer annular recess 52 receives the coil spring 42. Hanger mount 48 further includes a pair of bearings 56 that are received in the inner annular recess 53. Axle 30 is received in the bearings 56 such that hanger mount 48 may oscillate relative to the axle 30. The disk shaped cap 34 closes off both of the annular recesses 52 and 53. The phrase "immediately driving" refers to where a movement or ceasing of movement by one adjacent element causes a respective movement or ceasing of movement in its adjacent element.

In other words, a first train of the swing mechanism 10 includes electric motor 14, worm gear 18, rotating gear 20, a crank 22, axle drive 24, axle 30, disk shaped cap 34, and pin end 40. A rotation or ceasing of rotation of worm gear 18 by electric motor 14 causes an immediate respective rotation or ceasing or rotation of pin end 40. A second drive train of the swing mechanism includes opposite pin end 44, hanger mount 48, tube-like end 50, hanger 66 and baby seat 68. A swinging or a ceasing of swinging (such as by grabbing seat 68) causes an immediate respective oscillation or ceasing of oscillation of pin end 44, which is isolated from pin end 40. When pin end 44 stops oscillating, such as when seat 68 is grabbed, pin end 40 maintains its oscillation by virtue of the coil between the ends 40 and 44, thereby minimizing strain on the electric motor 14. Further, if desired, coil spring 42 may be manufactured to be relatively rigid such that a grabbing of seat 68 results in the stopping force being transmitted through the second drive train through the spring 42 and through the first drive train to the motor 14 which is of sufficient quality to safely and without breakdown withstand such force even for long periods over which an otherwise swinging seat 68 is held.

Figure 1:
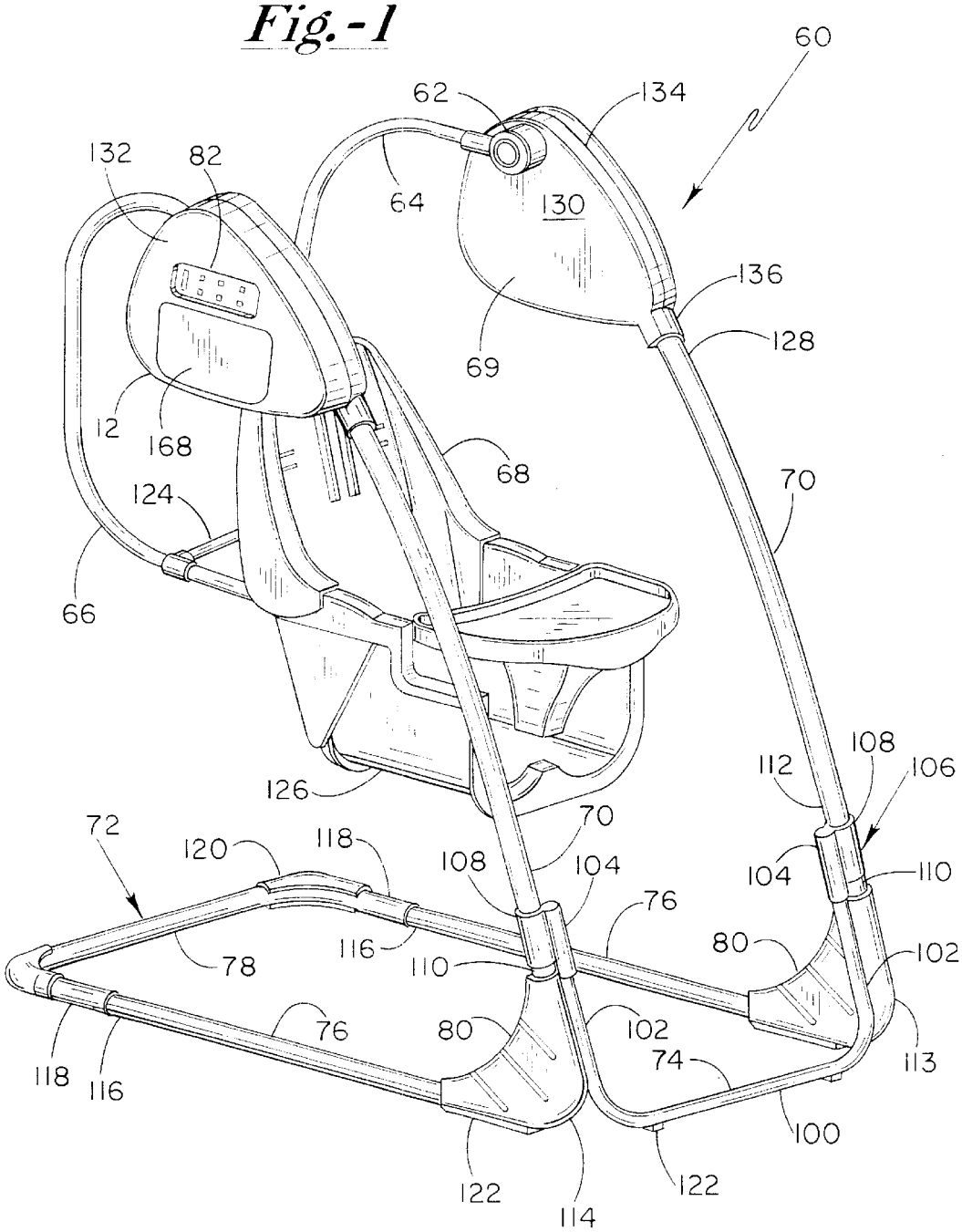
FIG. 1 shows a perspective view of the present open top swing.

As shown in FIG. 1, reference number 60 indicates in general the open top swing. Housing 12 is shown, and a passive hanger mount 62 is shown. Arm or hanger 64 depends from hanger mount 62 and arm or hanger 66 depends from hanger mount 48. The distal ends of hangers 64 and 66 engage baby seat 68. Passive hanger mount 62 is pivotably fixed to a housing 69. Housings 12 and 69 are mounted on a pair of support legs 70 engaged to a rectangular shaped base 72. Base 72 includes four tubes or support members. consisting of a U-shaped front tube 74, generally L-shaped side tubes 76 that extend both horizontally and vertically, and a U-shaped rear tube 78. A generally aesthetic member 80 is positioned over an integral transition portion of the side tubes 76. It should be noted that the member 80 provides some bracing support.

Figure 4:
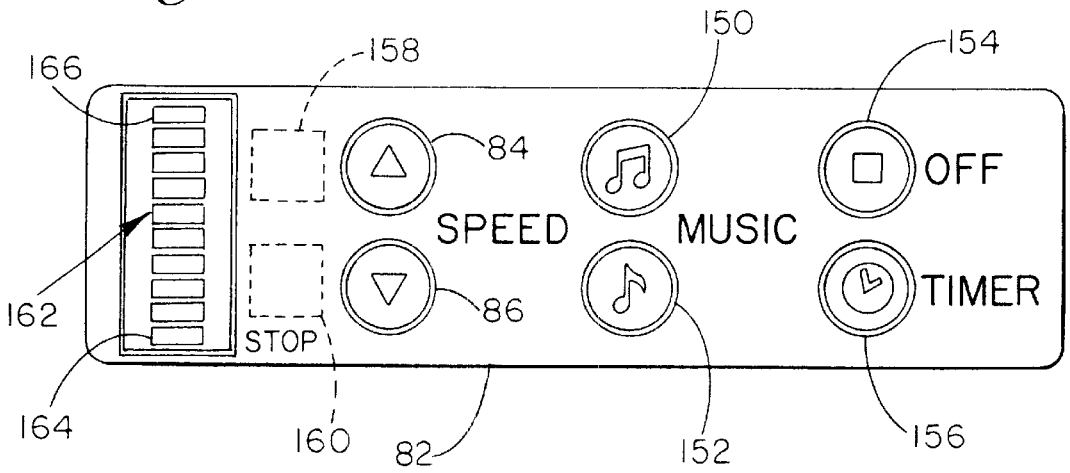
FIG. 4 shows a detail view of the control panel for the open top swing of FIG. 1.

As shown in FIG. 4, a control panel 82 is provided for the swing mechanism 10 and is disposed on housing 12. The control panel 82 includes two speed controls or switches 84 and 86. Speed control or switch 84 increases the speed of electric motor 14 and speed control or switch 86 decreases the speed of electric motor 14. Control panel 82 further includes a switch 150 having a first musical rendition and a switch 152 having a second and different musical rendition. Control panel 82 further includes an off switch 154, timer switch 156, speed digital readout 158, a time or timer digital readout 160, and a bank or line of lights 162 which includes a lower light 164 and an upper light 166. The circuitry for the off switch may be set so that turning the switch 154 on or off turns on or off one or more of the motor 14, timer 156 and music. Timer switch 156 may be set so as to turn on or off, after a chosen period of time, one or more of the motor 14 and music. Digital readout 158 may present in numerical form or alphabetical form or other character form the speed of electric motor 14. Digital readout 160 may present in numerical form or alphabetical form or other character form the time of day and/or the time period set by switch 156. The bank of lights 162 includes a lowermost individual light 164 and an uppermost individual light 166. The bank of lights 162 runs in a straight, vertical line and may be electrically associated with the speed of the motor 14. When the motor 14 is off, the entire bank of lights 162 is off. When the motor 14 is running at a relatively slow speed, only light 164 or its adjacent lights are lit. When the motor 14 is running at a relatively high speed, the entire bank of lights 162 may be on or a few of the upper lights, including light 166, may be off. The more lights of bank 162 that are lit, the higher the speed the motor 14 is running. Further, the lights of the bank 162 turn on and off in progressive fashion one by one. For example, as speed increases, the lights turn on one by one starting with lower light 164. As speed decreases starting from the fastest most speed, light 166 turns off and then the adjacent light below it and then the other lights in turn, from adjacent light to adjacent light, until light 164 turns off. The term "stop" on the control panel 82 is imprinted near light 164 to tell the caregiver that the motor 1-4 is off when light 164 is off. Housing 12 further includes a battery power source 168 and the bank of lights 162 may indicate the life of the battery power source 168 instead of the speed of motor 14. Where no lights are indicated, the power source 168 may have insufficient power to operate the motor 14 or swing 60. Where the power source 168 has sufficient power, all of the lights of bank 162 may be lit. Then, in turn, when the life of the power source decreases, the lights of bank 162 turn off one by one over time from light 166 to light 164. In other words, the bank of lights 162 may be associated with a function (such as power or speed) and a value that indicates the life of a power source or the speed of a motor.

Front or cross tube 74 is U-shaped and includes a middle, floor-confronting member portion 100 and a pair of side member portions 102. Each of the upper ends of the side member portions 102 is received in a first tube receptor 104 of a tube connector 106. Upper or male ends of side member portions 102 may include a pin biased outwardly so as to engage a hole formed in tube receptor 104. Tube connector 106 includes a second tube receptor 108 that receives a front and upper end 110 of side tube 76, which extends horizontally and vertically through brace 80. Upper end 110 of side tube 76 is female and receives a male end of lower portion 112 of leg 70. Male end of lower portion 112 includes a pin biased outwardly so as to engage a first hole formed in upper end 110 of side tube 76 and so as to engage and further extend through a second hole aligned with the first hole and formed in tube receptor 108. Upper end 110 of side tube 76 is female from a location 113 just above the termination of a radius 114. The male end of lower portion 112 is received down to location 113 so as to provide a broad or elongate interaction between legs 70 and side tubes 76. Since side tube 76 forms a portion of the side of base 72 and since side tube 76 forms a portion of the leg support for seat 68 relative to a floor, the portion of side tube 76 extending through brace 80 and including top end 10 is referred to as an integral transition. It should be noted that side member portions 102 of front tube 74 are engaged at a location well spaced from the floor to engage a location as far up the frame as possible so as to minimize side to side swaying of the open top swing 60. It should be noted that side member portions 102 then run down lower leg portion or tube end 110, and that middle portion 100 then runs across the floor to provide open space for the open top swing 60. Each of the tubes or side support members 76 includes a rear end portion 116 that includes a male end that fits inside a female end 118 of rear tube 78. The male end of portion 116 may include a pin biased outwardly so as to engage a hole formed in female end 118. Rear tube 78 extends through a pair of corner supports 120. Corner supports 120, braces 80 and front tube 74 may include nonskid feet 122.

It should be noted that legs 70 run, from lower portions 112, upwardly and rearwardly in a curvilinear fashion. More specifically, the legs 70 run, from lower portions 112 in a curvilinear fashion, at a greater rate upwardly than rearwardly.

It should be noted that legs 70 provide the sole means of support for the baby seat 68 relative to the floor. In other words, the legs 70 are engaged to the housings 12 and 69, which are in turn engaged to the arms or hangers 64, 66, which in turn at their distal ends are engaged to the baby seat 68. A cross brace 124 extends between the arms 64, 66 to support the arms 64, 66 relative to each other and also support a reclining of the back of seat 68.

It should be noted that both legs 70 and upper ends 110 of side support members 76 are, in combination, the legs of open top swing 60 since such elements provide support in a vertical fashion.

It should be noted that the baby seat 68 includes a lower face 126 and that each of legs 70 includes an upper end portion 128 that runs into its respective housing 12 or 69. Preferably, upper end or leg portion 10 terminates at a height greater than one-half the distance from the floor (or a plane defined by rear tube 72 and middle support member portion 100) to the lower face 126 of baby seat 68, where such height is also less than where upper end portion 128 runs into its respective housing 12 or 69. More preferably, upper end or leg portion 110 terminates at a height greater than two-thirds the distance from the floor (or a plane defined by rear tube 72 and middle support member portion 100) to the lower face 126 of baby seat 68, where such height is also less than where upper end portion 128 runs into its respective housing 12 or 69. Such provides a broad interaction between leg portions 110 and legs 70.

Preferably, the support member portions 102 of U-shaped cross support member 74 terminate at (and are engaged to leg portions 110 at) a height greater than one-half the distance from the floor (or a plane defined by rear tube 72 and middle support member portion 100) to the lower face 126 of baby seat 68, where such height is also less than where upper end portion 128 runs into its respective housing 12 or 69. More preferably, the support member portions 102 of U-shaped cross support member 74 terminate at (and are engaged to leg portions 110 at) a height greater than two-thirds the distance from the floor (or a plane defined by rear tube 72 and middle support member portion 100) to the lower face, 126 of baby seat 68, where such height is also less than where upper end portion 128 runs into its respective housing 12 or 69. Such minimizes a side to side swaying of the open top swing 60 because the cross support provided by cross support 74 is located high in the frame of the open top swing 60. Such maximizes or retains the open space provided by the frame of the open top swing 60 because middle portion 100 of the cross support 74 remains on the floor.

It should be noted that a side section of the frame of the open top swing 60 includes one of the legs 70 and the control unit 12 and that another side section of the frame of the open top swing 60 includes the other of the legs and the ornamental or passive unit 69. An open space runs between these side sections. Preferably, this open space runs more than one-half of the way down legs 70, more preferably two-thirds of the way down legs 70, and most preferably all the way down to the upper edge of middle portion 100 of tube 74.

It should be noted that passive or ornamental housing or unit 69 has the generally the same shape as housing or unit 12. Housing or look-alike unit 69 is thinner in width than housing 12. Each of housings 12 and 69 are generally triangular in shape with rounded comers. Each of the housings 12 have an inner triangular face 130 with rounded corner portions and an outer triangular face 132 with rounded corner portions. Each of the housings 12 and 69 are formed of two half sections that meet at a visible seam 134. Each of the housings 12 and 69 have a tube receptor 136 extending from its respective housing to engage a male end of upper portion 128 of leg 70. The male end of upper portion 128 may include a pin biased outwardly to engage a hole in tube receptor 136 for connecting the legs 70 to the housing 12 and 69.

It should be further noted, if looking directly down upon the open top swing 60 from above, that the base 72 is sufficiently deep such that a back of seat 68 is within the rear middle portion of tube 78 and such that a front of seat 68 is within middle portion 100. It should be noted further that the base 72 is sufficiently wide such that sides of seat 68 are within side support members 76 if looking directly down upon the open top swing 60 from above.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A baby swing, comprising:

a) a frame and a baby seat swingably engaged to the frame via an arm; and b) a swing mechanism engaged to the frame for swinging of the baby seat, wherein the swing mechanism comprises:

i) a housing;

ii) an electric motor engaged to the housing;

iii) a worm gear extending from the electric motor and being driven by the motor;

iv) a rotating gear pivotally affixed to the housing and including a crank;

v) an axle drive mounted to the housing via a bearing, wherein the axle drive includes a slot, wherein the axle drive is driven by the crank engaging the slot;

vi) an axle having a first and second end, with the axle further having a spline, wherein the axle drive drives the axle, wherein the first end of the axle is fixedly received by the axle drive which is formed to receive the spline of the axle such that rotation and oscillation is prevented between the axle drive and axle;

vii) a cap having a central aperture shaped to receive the axle and the spline of the axle in a nonrotating, fixed fashion, wherein the cap further includes a peripheral aperture;

viii) an integral coil spring having first and second ends, wherein the first end is engaged in the peripheral aperture of the cap such that the cap must immediately drive said first end;

ix) a hanger mount, wherein the hanger mount is pivotally joined to the second end of the axle via a bearing between the second end of the axle and the hanger mount such that the hanger mount may oscillate relative to the axle, wherein the coil spring is received within the hanger mount and the cap closes off the hanger mount with the coil spring received therein, wherein the hanger mount engages the arm that in turn is engaged to the baby seat, wherein the hanger mount includes an aperture to receive the second end of the coil spring such that said second end must immediately drive said hanger mount such that rotation of the worm gear immediately rotates the crank which in turn immediately oscillates the axle drive which in turn immediately oscillates the cap which in turn immediately oscillates one end of the coil spring which in turn is isolated from the second end of the integral coil spring which in turn immediately oscillates the hanger mount which in turn immediately oscillates the arm which in turn immediately oscillates the baby seat.

2. A baby swing, comprising:

a) a frame and a baby seat swingably engaged to the frame via an arm; and b) a swing mechanism engaged to the frame for swinging of the baby seat, wherein the swing mechanism comprises:

i) a housing;

ii) an electric motor engaged to the housing and rotating a shaft;

iii) a first drive train having a first end and a second end, wherein the first end of the drive chain is engaged to the shaft;

iv) a coil spring having first and second ends, wherein the first end of the coil spring is directly engaged to the second end of the first drive train such that any partial rotation of the shaft produces a swinging movement of the first end of the coil spring and such that any partial swinging movement of the first end of the coil spring exerts an immediate force on the shaft of the electric motor;

v) a second drive train having first and second ends, wherein the first end of the second drive train is engaged to the second end of the coil spring;

vi) a hanger mount, wherein the hanger mount is fixedly engaged to the arm that swings the baby seat, wherein the second end of the coil spring is engaged to the hanger mount such that any partial swinging of the second end of the coil spring produces a swinging movement of the arm and thus baby seat and such that any stopping of a swinging of the baby seat produces an immediate stopping of a swinging of the second end of the coil spring wherein the coil spring isolates the electric motor from the baby seat.

3. A baby swing, comprising:

a) a frame and a baby seat swingably engaged to the frame via an arm;

b) a swing mechanism engaged to the frame for swinging of the baby seat, wherein the swing mechanism comprises an electric motor; and c) a control unit for controlling the speed of the electric motor, comprising:

i) a first switch for increasing the speed of the electric motor;

ii) a second switch for decreasing the speed of the electric motor; and iii) a bank of lights running in a line, wherein the speed of the electric motor is associated with the number of lights lit, wherein a greater speed of the electric motor is associated with agreater number of lights being lit, wherein a lesser speed of the electric motor is associated with a lesser number of lights being lit, and wherein the lights electrically turn on and off in progressive fashion.

4. The baby swing according to claim 3, wherein the bank of lights runs in a straight line.

5. The baby swing according to claim 4, wherein the line includes two ends, wherein one end of the line includes an end light, wherein an unlit end light denotes that the electric motor has stopped.

6. A baby swing, comprising:

a) a frame and a baby seat swingably engaged to the frame via an arm;

b) a swing mechanism engaged to the frame for swinging of the baby seat, wherein the swing mechanism comprises an electric motor and a power source; and c) a control unit, wherein the control unit includes a function, wherein the control unit further comprises a bank of lights running in a line, wherein the function is associated with the number of lights lit, wherein a greater value of the function is associated with a greater number of lights being lit, wherein a lesser value of the function is associated with a lesser number of lights being lit, and wherein the lights electrically turn on and off in progressive fashion.

7. The baby swing according to claim 6, wherein the function is power and the value is a life of the power source.

8. The baby swing according to claim 6, wherein the function is speed and the value is the speed of the motor.

9. The baby swing according to claim 6, wherein the line includes two ends wherein one end of the line includes an end light, wherein an unlit end light denotes that the function has stopped.

10. The baby swing according to claim 6, wherein the control unit further comprises a read out for the speed of the electric motor.

11. The baby swing according to claim 6, wherein the control unit further comprises a read out for a chosen period of time for running the motor.

12. A baby swing, comprising:

a) a base;

b) a first leg, wherein the first leg is engaged to the base, wherein the first leg includes upper and lower portions;

c) a second leg, wherein the second leg is engaged to the base, wherein the second leg includes upper and lower portions;

d) a first housing engaged to the upper portion of the first leg;

e) a second housing engaged to the upper portion of the second leg;

f) a first arm pivotally joined to the first housing, wherein the first arm includes a proximal portion and a distal portion, wherein the first arm is swung directly by the first housing;

g) a second arm pivotally joined to the second unit, wherein the second arm includes a proximal portion and a distal portion, wherein the second arm is swung indirectly by the first housing;

h) a baby seat engaged to the distal portions of the arms, wherein the first and second legs provide support for the baby seat relative to the base;

i) wherein the baby swing comprises a frame, wherein the frame comprises the base, the first and second legs, and the first and second housings, wherein the frame further comprises a first side section and a second side section, wherein the first side section comprises the first leg and the first housing, wherein the second side section comprises the second leg and the second housing, wherein each of the first and second side sections of the frame comprises an upper portion, and wherein the frame is free of cross supports extending between the upper portions of the side sections of the frame such that the baby swing is an open top baby swing;

j) wherein the first housing comprises a control unit having a swing mechanism for swinging the proximal end of the first arm;

k) wherein the second housing is a look-alike housing that has a generally similar appearance to the first housing;

l) wherein the swing mechanism comprises an electric motor and a power source;

m) wherein the control unit further comprises a first digital readout associated with a speed of the electric motor; and n) wherein the control unit further comprises a second digital readout associated with a chosen period of time for turning the electric motor on or off.

13. The baby swing according to claim 12, wherein the control unit further comprises: a bank of lights running in a line, wherein a life of the power source is associated with the number of lights lit, wherein a greater amount of life of the power source is associated with a greater number of lights being lit, wherein a lesser amount of life of the power source is associated with a lesser number of lights being lit, and wherein the lights electrically turn on and off in progressive fashion.

* * * * *